US008291681B2

(12) United States Patent
Palmer et al.

(10) Patent No.: US 8,291,681 B2
(45) Date of Patent: Oct. 23, 2012

(54) CAP TIGHTENING MECHANISM AND CAPPING SYSTEM AND METHOD INCORPORATING SAME

(75) Inventors: Mike Palmer, New Wilmington, PA (US); Nick Kulka, West Middlesex, PA (US)

(73) Assignee: International Plastics and Equipment Corp., New Castle, PA (US)

( * ) Notice: Subject to any disclaimer, the term of this patent is extended or adjusted under 35 U.S.C. 154(b) by 350 days.

(21) Appl. No.: 12/546,033

(22) Filed: Aug. 24, 2009

(65) Prior Publication Data

US 2011/0041465 A1 Feb. 24, 2011

(51) Int. Cl.
*B67B 3/18* (2006.01)

(52) U.S. Cl. ..... 53/490; 53/331.5; 53/334; 53/485

(58) Field of Classification Search ..... 53/490, 53/485, 331.5, 334, 343, 317–319
See application file for complete search history.

(56) References Cited

U.S. PATENT DOCUMENTS

| | | | | |
|---|---|---|---|---|
| 2,909,879 | A | 10/1959 | Hohl et al. | |
| 3,073,090 | A * | 1/1963 | Roberts et al. | 53/331.5 |
| 3,435,587 | A * | 4/1969 | Weller | 53/317 |
| 5,197,258 | A | 3/1993 | Johanek | |
| 5,417,031 | A * | 5/1995 | Bankuty et al. | 53/331.5 |
| 5,584,161 | A * | 12/1996 | Zanini et al. | 53/317 |
| 6,945,011 | B2 * | 9/2005 | Hidding et al. | 53/167 |
| 7,003,927 | B2 * | 2/2006 | Yang | 53/331.5 |
| 7,866,237 | B2 * | 1/2011 | Vesentini | 81/467 |

FOREIGN PATENT DOCUMENTS

| | | |
|---|---|---|
| GB | 660379 | 11/1951 |
| GB | 789389 | 1/1958 |

OTHER PUBLICATIONS

The International Bureau of WIPO, "International Preliminary Report on Patentability", Feb. 28, 2012, 8 pp.

* cited by examiner

*Primary Examiner* — Thanh Truong
(74) *Attorney, Agent, or Firm* — Eckert Seamans Cherin & Mellott, LLC; Stephen A. Bucchianeri

(57) ABSTRACT

A mechanism for tightening a partially threaded cap on a container passing along a production line. The mechanism includes a first member having a first end and a second end. The first end being structured to be coupled at or near the production line and the second end being rotatable with respect to the first end. The mechanism further including a second member coupled to the second end of the first member and rotatable therewith. The second member having a plurality of cap engaging portions, each of the cap engaging portions being structured to engage the partially threaded cap on a container passing along the production line in a manner that tightens the partially threaded cap.

21 Claims, 4 Drawing Sheets

CAP TIGHTENING MECHANISM AND CAPPING SYSTEM AND METHOD INCORPORATING SAME

FIELD OF THE INVENTION

The disclosed concept pertains generally to production line systems and, more particularly, to production line systems including capping mechanisms. The disclosed concept also pertains to cap tightening mechanisms and further to methods of tightening caps.

BACKGROUND OF THE INVENTION

There are many different types of known plastic containers for holding liquids sold to consumers such as water bottles and milk jugs. Such containers commonly have reclosable lids or caps that either press or thread onto the particular container. Such containers are generally initially filled with liquid in a production line which then seals the container by adding the particular cap for the container. Known capping equipment used in such processes for threading and tightening caps is generally complicated due to the movement and forces required to accurately and sufficiently place and torque a threaded cap on to the opening of a container. Additionally, due to the time required to perform such action and the rate at which production lines commonly operate, several individual capping units are typically combined in one large capping unit that can accommodate several containers at a given time. An example of such a unit is a "screw tightener" unit, manufactured by IPEC of New Castle, Pa. Such a screw tightener unit utilizes a plurality of individual tightening mechanisms arranged in a single, large turntable unit.

Due to the complexity of the equipment, such known capping equipment for installing threaded caps is generally quite expensive. Additionally, such known capping equipment generally occupies a large amount of space along a typically crowded production line. Such large size and cost tends to make use of such capping equipment by smaller production facilities either difficult or impossible.

Accordingly, there exists a need in the art for improved capping equipment for installing and tightening threaded caps.

SUMMARY OF THE INVENTION

In accordance with an embodiment of the disclosed concept, a mechanism for tightening a partially threaded cap on a container passing along a production line is provided. The mechanism comprises a first member and a second member. The first member having a first end and a second end, the first end being structured to be coupled at or near the production line, the second end being rotatable with respect to the first end. The second member being coupled to the second end of the first member and rotatable therewith. The second member having a plurality of cap engaging portions, each of the cap engaging portions being structured to engage the partially threaded cap on a container passing along the production line in a manner that tightens the partially threaded cap.

The first member may include a resistance mechanism that provides an adjustable resistance to rotation of the second end with respect to the first end. The resistance mechanism may comprise a first set of magnets fixed with respect to the first end and a second set of magnets fixed with respect to the second end and spaced a distance from the first set. The resistance mechanism may further comprises a spacer member disposed between the first set of magnets and the second set of magnets.

Each of the cap engaging portions may be disposed at or near a periphery of the second member. Each of the plurality of cap engaging portions may comprise a number of serrations. The number of serrations may be arranged in an arc-like manner. The plurality of cap engaging portions may comprise four portions.

In accordance with another embodiment of the disclosed concept, a system for tightening a threaded cap on a container is provided. The system comprises a production line structured to move a plurality of containers, each container having a partially threaded cap and a mechanism structured to tighten each of the partially threaded caps onto a respective container. The mechanism comprises a first member and a second member. The first member having a first end and a second end, the first end being structured to be coupled at or near the production line and the second end being rotatable with respect to the first end. The second member being coupled to the second end of the first member and rotatable therewith. The second member having a plurality of cap engaging portions, each portion being structured to engage the partially threaded cap on the respective container passing along the production line in a manner that tightens the partially threaded cap onto the container.

The first member may include a resistance mechanism that provides an adjustable resistance to rotation of the second end with respect to the first end. The resistance mechanism may comprise a first set of magnets fixed with respect to the first end and a second set of magnets fixed with respect to the second end and spaced a distance from the first set. The resistance to rotation may be varied by varying the distance between the first set and the second set.

Each of the plurality of cap engaging portions may disposed at or near a periphery of the second member. Each of the plurality of cap engaging portions may comprise a number of serrations. The number of serrations may be arranged in an arc-like manner. The plurality of cap engaging portions may comprise four portions.

The mechanism may be structured such that no more than one of the plurality of cap engaging portions engages a cap at any given time.

The second member may be structured to rotate a fraction of a revolution as a result of the engagement of a cap engaging portion and a cap on one of the plurality of containers being moved by the production line.

The production line may include one or more portions structured to limit movement of each of the plurality of containers.

In accordance with a further embodiment of the disclosed concept, a method of tightening a threaded cap on a container is provided. The method comprising providing a mechanism comprising a first member and a second member. The first member having a first end and a second end, the first end coupled to a fixed point, the second end being rotatable with respect to the first end. The second member being coupled to the second end of the first member, the second member having a plurality of cap engaging portions. The method further comprising providing a container having a threaded cap thereon and moving the container relative to the mechanism such that the threaded cap engages one of the cap engaging portions The first member may include a resistance mechanism that provides an adjustable resistance to rotation of the second end with respect to the first end. The method may further comprise selecting the torque applied to the partially threaded cap by adjusting the resistance of the resistance mechanism prior to providing the torque.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

As employed herein, the term "partially threaded" shall mean a cap or equivalent member having threads that is placed on a container having similar cooperating threads in a manner such that the cooperating threads are not fully threaded (i.e., not tightened down).

As employed herein, the term "number" shall mean any non-zero quantity, including one or a quantity greater than one.

Figure 1:
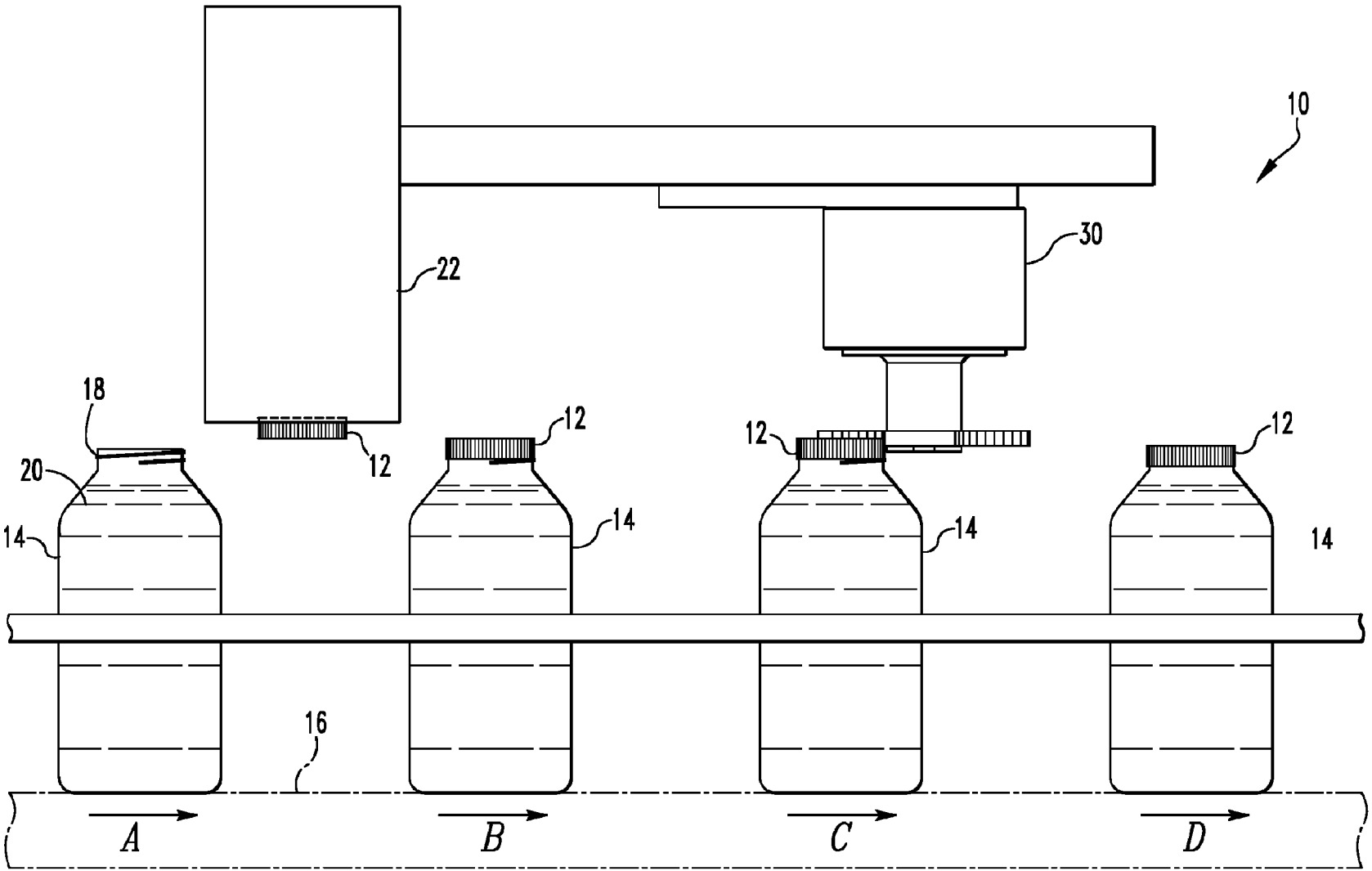
FIG. 1 is a schematic view of a capping system in accordance with an embodiment of the disclosed concept.

FIG. 1 illustrates a capping system 10 for installing a threaded cap 12 onto a container 14 moving along a production line 16. Production line 16 is generally known and includes a conveyor (not numbered) or other suitable mechanism for moving a number of containers 14 in a controlled manner through a number of processing stations in a production line. It is to be appreciated that production line 16 is adapted to handle a large volume of containers 14 over a given time, however, for ease of discussion, the progression of a single container 14 in four different positions (labeled A-D) as the container 14 moves along the production line 16 in the direction shown by the arrows will be described in detail.

Continuing to refer to FIG. 1, container 14, shown at first position A, is for example a commonly known container made of polyethylene or other suitable material for storing a liquid 20 and includes a threaded opening 18 through which material may be added or removed from the container 14. Container 14 has been filled with a pre-determined quantity of liquid 20 (e.g., without limitation, milk) prior to arriving at position A along the production line 16.

In moving from position A to position B along production line 16, container 14 passes under a cap dispensing mechanism 22 that places, and partially threads, a cap 12 onto the threaded opening 14. Cap dispensing mechanism 22 may, for example, without limitation, comprise a known pick-off head having a straight serrated bar providing a pre-start to threading the cap 12. Next the container 14 moves to position C along production line 16 where the container 14, along with its partially threaded cap 12, encounters a cap tightening mechanism 30 such as shown in greater detail in FIGS. 2-4 and discussed further below.

Figure 2:
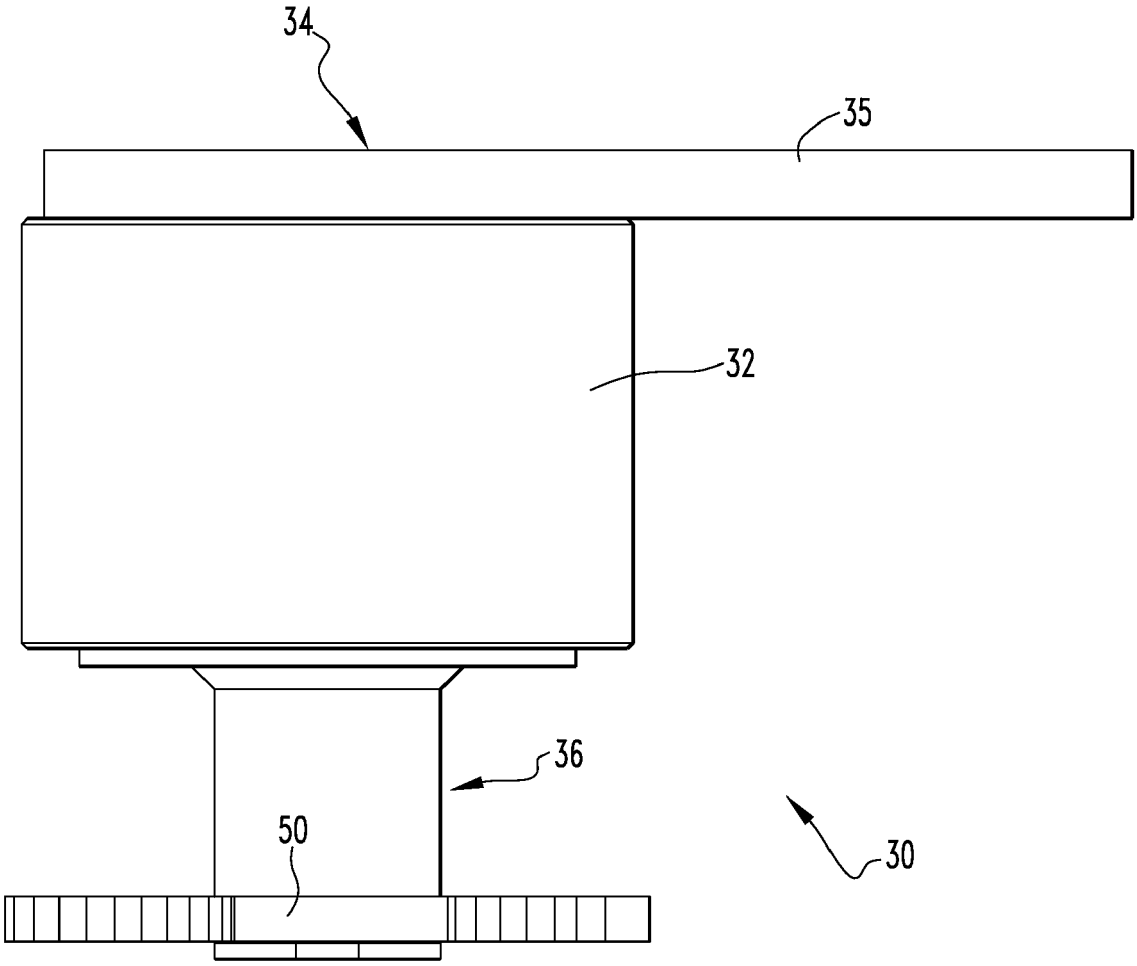
FIG. 2 is an elevation view of a capping mechanism is accordance with an embodiment of the disclosed concept.

Referring to FIG. 2, cap tightening mechanism 30 includes a first member 32 having a first end 34 and a second end 36. First end 34 is structured to be coupled at or near the production line 16. Accordingly first end 34 may include a mounting bracket or plate 35 or other suitable member for securely mounting/coupling first end 34 at or near production line 16. In the example embodiment shown, plate 35 further includes a number of curved apertures 37 (FIG. 4) for adjustably coupling the cap tightening mechanism 30 at or near production line 16. Second end 36 of cap tightening mechanism 30 is generally rotatable with respect to the first end 34. In the preferred embodiment shown in cross-section in FIG. 3, first end 34 is part of an upper member 38 and second end 36 is part of a lower member 40 arranged to rotate with respect to upper member 38 about a central axis 42.

Figure 3:
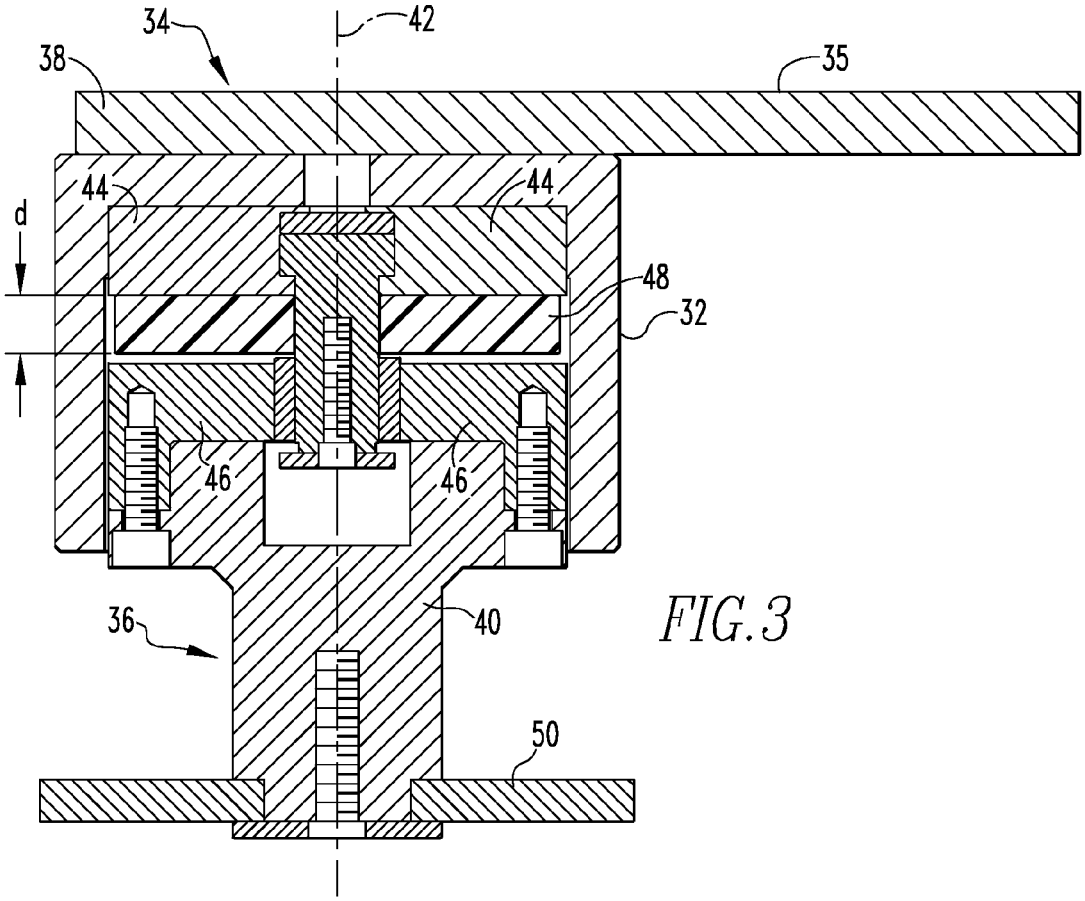
FIG. 3 is a sectional view of the capping mechanism of FIG. 2 taken along lines 3-3.

Continuing to refer to FIG. 3, upper member 38 includes a number of upper magnetic members 44 disposed radially about central axis 42 in a fixed position with respect to upper member 38. Lower member 40 likewise includes a number of corresponding lower magnetic members 46 disposed radially about central axis 42 in a fixed position with respect to lower member 40. Each of the upper magnetic members 44 and the lower magnetic members 46 are separated by a predetermined distance d, generally occupied by a ring-like spacer member 48, and are arranged in a manner such that their magnetic forces are attractive. In other words, each and all of the upper magnetic members 44 are attracted toward each and all of the lower magnetic members 46, and vice versa. It can be readily appreciated that such arrangement provides for a resistance to rotation between the lower member 40 and upper member 38 due to the attractive forces between the upper magnetic members 44 and the lower magnetic members 46. The effective attractive force between each of the corresponding upper magnetic members 44 and lower magnetic members 46, and thus the resistance to rotation between the lower member 40 and upper member 38 may be varied by increasing the distance d, and thus decreasing the resistance to rotation, or by decreasing the distance d, and thus increasing the resistance to rotation. Ring-like spacer member 48 is preferably formed of a white acetal material (e.g., without limitation, Delrin®), or other material suitable for occupying and preventing unwanted objects from interfering with the space between the upper magnetic members 44 and the lower magnetic members 46.

Although the embodiment shown in FIG. 3, and described herein, employs a magnetic resistance mechanism, it is to be appreciated that other resistance mechanisms (e.g., without limitation, slip-clutch type mechanism) both adjustable and fixed may be employed without varying from in the scope of the disclosed concept.

Figure 4:
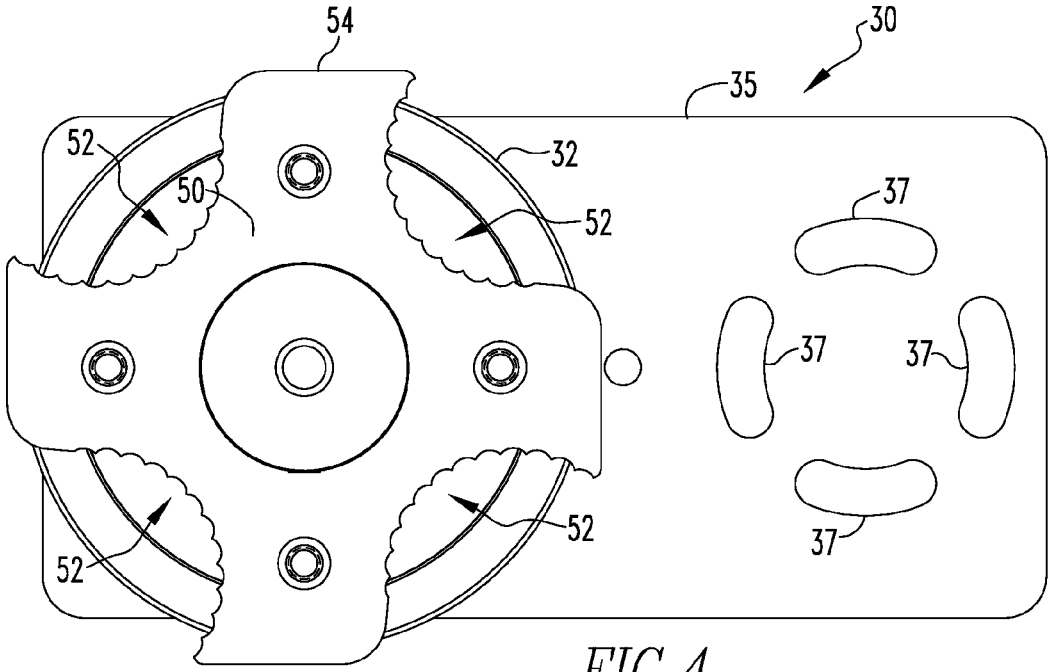
FIG. 4 is a bottom view looking up at the capping mechanism of FIG. 2.

Tightening mechanism 30 further includes a second member 50 coupled to the second end 36 of the first member 32 and rotatable therewith. Preferably, second member 50 is made from one quarter inch thick 300 or 400 series stainless-steel, although other suitable materials and thicknesses may be employed without varying from the scope of the present invention. Referring to FIG. 4, second member 50 includes a number of serrated portions 52, each portion being generally arranged in an arc-like shape, disposed about an outer periphery 54 of second member 50. In the preferred embodiment shown, second member 50 includes 4 serrated portions, each serrated portion 52 having 12 serrations (not numbered) spaced equally ⅛ inch apart. It is to be appreciated however that the size, quantity and spacing of the serrations may be varied without departing from the scope of the invention.

Each of serrated portions 52 are sized and structured to engage the outer surface of a cap 12 previously disposed on a container 14 passing along the production line 16 as discussed above. Preferably, each serrated portion 52 is sized to cover approximately 120 degrees of a cap 12 when fully engaged with the inside radius of the serrated portion 52 being very close to the same dimension as the outside diameter of the cap 12. Additionally, the outer surface of cap 12 is preferably textured (e.g., without limitation, serrated) to provide extra grip for engagement by one of the serrated portions 52.

Having thus described the cap tightening mechanism 30, operation thereof as part of production line 16 will now be described in reference to FIG. 5 which schematically depicts a threaded cap 12 of a container 14 (not shown in FIG. 5) as it passes under, and engages second member 50 of cap tightening mechanism 30. In other words, FIG. 5 shows a view of the cap tightening process as viewed looking upward from the perspective of a container 14 on which a cap 12 is being tightened in a counter-clockwise direction.

Figure 5:
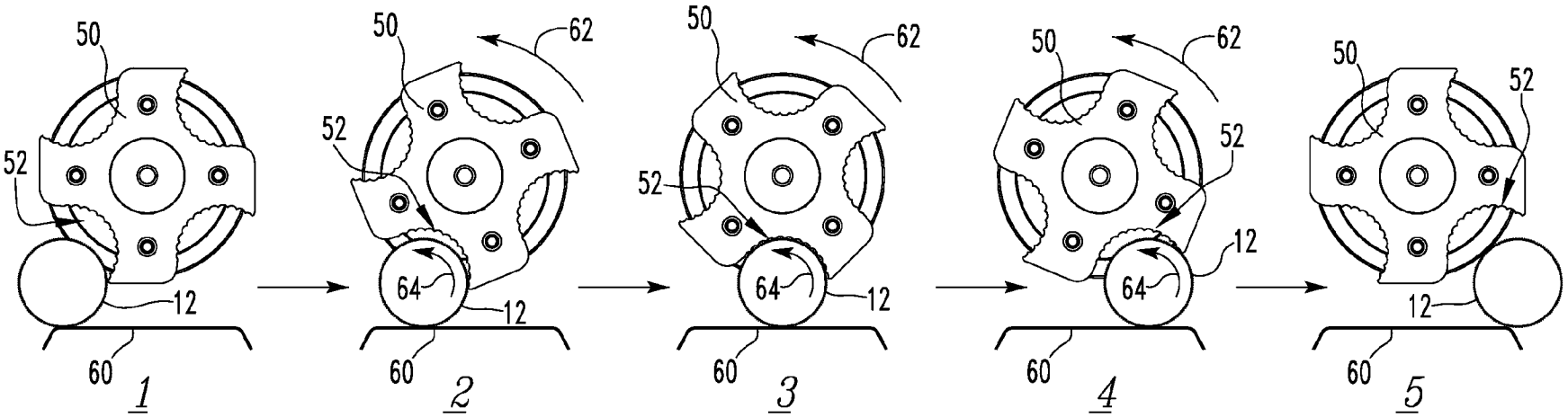
FIG. 5 shows progressive views of the engagement and tightening process of a cap on a container passing along a production line in engagement with a portion of the capping mechanism depicted in FIG. 4.

Section I. of FIG. 5 shows a cap 12 as it first engages second member 50 as cap 12 moves in a generally left-to-right direction along production line 16. Referring to Sections II-IV. of FIG. 5, second member 50 rotates in a counter-clockwise direction (shown by arrow 62) as cap 12 engages one of the serrated portions 52 of second member 50 and continues moving along the production line 16. Such engagement between the outer surface (not numbered) of cap 12 and the serrated portion 52 also causes the cap 12 to rotate in a counter-clockwise (tightening, shown by arrow 64) direction due to the serrations gripping the periphery of cap 12. In order to increase such gripping, a brace member 60 may further be provided generally opposite the tightening mechanism 30. Preferably, such brace member 60 engages at least one of the container 14 or the cap 12 in a manner that resists movement of the cap 12 away from second member 50. A single brace member 60 may be fixed in position with respect to the tightening mechanism 30, such as shown in FIG. 5, or alternatively, a plurality (not shown) of brace members 60 may be provided, with each of such brace members being fixed in position with respect to a container 14 and cap 12 moving along the production line 16.

The predetermined resistance to rotation of second member 50, previously discussed, provides for a generally predetermined amount of torque to be applied to the cap 12 as it engages and rotates second member 50. Accordingly, the amount of torque applied to each cap 12 may be varied by varying the resistance of rotation of the second member 50 in regard to the first member 32.

As shown in FIG. 5, second member 50 is structured to engage one cap 12 at any given time. Furthermore, as also shown in FIG. 5, such engagement of a cap 12 moving along the production line 16 causes the second member to rotate a fraction of a revolution. In the example shown, four serrated portions 52 are employed and thus engagement of each serrated portion 52 with a cap 12 of a container 14 moving along production line 16 causes the second member to rotate a quarter of a revolution. Such engagement with the tightening mechanism 50 generally results in the cap 12 being tightened one quarter turn.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof. Furthermore, while the handle member and system have been described particularly in connection with riding or walk-behind lawn mowers, it is to be appreciated that use of the handle member and system is not intended to be limited to such applications as the invention could readily be applied to other mechanical equipment.

What is claimed is:

1. A mechanism for tightening a partially threaded cap on a container passing along a production line, the mechanism comprising:

a first member having a first end and a second end, the first end being structured to be coupled at or near the production line, the second end being rotatable with respect to the first end; and a second member coupled to the second end of the first member and rotatable therewith, the second member having a plurality of serrated portions, wherein each serrated portion of the plurality of serrated portions is structured to be engaged by a partially threaded cap on a respective container passing along the production line and solely as a result of such engagement: a) the second member is caused to rotate with respect to the first end of the first member and b) the partially threaded cap is tightened on the container as the container moves past the mechanism on the production line.

2. The mechanism of claim 1 wherein the first member includes a resistance mechanism that provides an adjustable resistance to rotation of the second end with respect to the first end.

3. The mechanism of claim 1 wherein the first member includes a resistance mechanism that provides a predetermined resistance to rotation of the second end with respect to the first end, the resistance mechanism comprising:

a first set of magnets fixed with respect to the first end; and a second set of magnets fixed with respect to the second end and spaced a distance from the first set.

4. The mechanism of claim 3 wherein the resistance mechanism further comprises a spacer member disposed between the first set of magnets and the second set of magnets.

5. The mechanism of claim 1 wherein the plurality of cap engaging portions are disposed about a periphery of the second member and wherein each of the cap engaging portions is disposed at or near the periphery of the second member.

6. The mechanism of claim 1 wherein each of the plurality of cap engaging portions comprises a number of serrations.

7. The mechanism of claim 6 wherein the number of serrations are arranged in an arc-like manner.

8. The mechanism of claim 1 wherein the plurality of cap engaging portions comprises four portions.

9. The mechanism of claim 1, further comprising a brace member structured to be coupled at or near the production line, the brace member being structured to engage a partially threaded cap on the respective container passing along the production line at a position generally opposite the portion being engaged by the serrated portion.

10. A system for tightening a threaded cap on a container, the system comprising:

a production line structured to move a plurality of containers, each container having a partially threaded cap; and a mechanism structured to tighten each of the partially threaded caps onto the respective container, the mechanism comprising:

a first member having a first end and a second end, the first end coupled at or near the production line, the second end being rotatable with respect to the first end; and a second member coupled to the second end of the first member and rotatable therewith, the second member having a plurality of serrated portions, wherein each serrated portion of the plurality of serrated portions is structured to be engaged by a partially threaded cap on a respective container passing along the production line and solely as a result of such engagement: a) the second member is caused to rotate with respect to the first end of the first member and b) the partially threaded cap is tightened on the container as the container moves past the mechanism on the production line.

11. The system of claim 10 wherein the first member includes a resistance mechanism that provides an adjustable resistance to rotation of the second end with respect to the first end.

12. The system of claim 10 wherein the first member includes a resistance mechanism that provides a predetermined resistance to rotation of the second end with respect to the first end, the resistance mechanism comprises:

a first set of magnets fixed with respect to the first end; and a second set of magnets fixed with respect to the second end and spaced a distance from the first set.

13. The system of claim 10 wherein each of the plurality of cap engaging portions is disposed at or near a periphery of the second member body portion.

14. The system of claim 10 wherein each of the plurality of cap engaging portions comprises a number of serrations.

15. The system of claim 14 wherein the number of serrations are arranged in an arc-like manner.

16. The system of claim 10 wherein the plurality of cap engaging portions comprises four portions.

17. The system of claim 10 wherein the mechanism is structured such that no more than one of the plurality of cap engaging portions engages a cap at any given time.

18. The system of claim 10 wherein the second member is structured to rotate a fraction of a revolution as a result of the engagement of a cap engaging portion and a cap on one of the plurality of containers being moved by the production line.

19. The system of claim 10 wherein the production line includes one or more portions structured to limit movement of each of the plurality of containers.

20. A method of tightening a threaded cap on a container, the method comprising:

providing a mechanism comprising:

a first member having a first end and a second end, the first end coupled to a fixed point, the second end being rotatable with respect to the first end; and a second member coupled to the second end of the first member, the second member having a plurality of serrated portions;

providing a container having a threaded cap thereon;

causing the second member to rotate, without the use of a drive motor coupled thereto, solely by moving the container relative to the mechanism such that the threaded cap engages one of the serrated portions; and tightening the cap on the container solely by continuing to move the container relative to the mechanism while the threaded cap is engaged with the one serrated portion.

21. The method of claim 20 wherein the first member includes a resistance mechanism that provides an adjustable resistance to rotation of the second end with respect to the first end, the method further comprising selecting the torque applied to the partially threaded cap by adjusting the resistance of the resistance mechanism prior to providing the torque.

* * * * *

UNITED STATES PATENT AND TRADEMARK OFFICE

CERTIFICATE OF CORRECTION

PATENT NO. : 8,291,681 B2
APPLICATION NO. : 12/546033
DATED : October 23, 2012
INVENTOR(S) : Mike Palmer et al.

It is certified that error appears in the above-identified patent and that said Letters Patent is hereby corrected as shown below:

In the Specification

Column 2, line 64, "portions" should read --portions in a manner that causes the second member to rotate and also that causes the threaded cap to tighten on the container.--.

Signed and Sealed this
Eleventh Day of March, 2014

Michelle K. Lee

Michelle K. Lee
*Deputy Director of the United States Patent and Trademark Office*